US007516595B2

(12) United States Patent
Dammers et al.

(10) Patent No.: US 7,516,595 B2
(45) Date of Patent: Apr. 14, 2009

(54) METHOD FOR APPLYING A RESEALABLE POURING ELEMENT TO A CONTAINER AND CORRESPONDING CONTAINER

(75) Inventors: Matthias Dammers, Alsdorf (DE); Hans-Willi Mainz, Heinsberg (DE); Sven Hagen, Grevenbroich (DE); Markus Wassum, Gottmadingen (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 105 days.

(21) Appl. No.: 10/520,673

(22) PCT Filed: Jul. 8, 2003

(86) PCT No.: PCT/EP03/07338

§ 371 (c)(1),
(2), (4) Date: Jul. 26, 2005

(87) PCT Pub. No.: WO2004/007290

PCT Pub. Date: Jan. 22, 2004

(65) Prior Publication Data

US 2006/0037966 A1 Feb. 23, 2006

(30) Foreign Application Priority Data

Jul. 10, 2002 (DE) ..... 102 31 063

(51) Int. Cl.
*B65B 61/00* (2006.01)

(52) U.S. Cl. ..... 53/410; 53/129.1; 53/287; 53/425; 493/87; 493/109; 422/302

(58) Field of Classification Search ..... 53/129.1, 53/131.3, 133.1, 133.2, 281, 287, 284.5, 53/410, 412, 425, 426, 167, 133.5, 133.7; 422/1, 26, 28, 302; 493/87, 109, 339
See application file for complete search history.

(56) References Cited

U.S. PATENT DOCUMENTS 2,355,073 A * 8/1944 Hothersall ..... 53/468

(Continued)

FOREIGN PATENT DOCUMENTS

DE 90 05 581 7/1990

(Continued)

OTHER PUBLICATIONS

Taiwanese Office Action dated Oct. 3, 2006.

(Continued)

*Primary Examiner*—Thanh K Truong
(74) *Attorney, Agent, or Firm*—The Webb Law Firm

(57) ABSTRACT

A method for applying a reclosable pouring element comprising a pouring opening and a flange and having a removable cap, to a container having an opening. The method comprising the steps of connecting the pouring element to a lid of the container having an opening by affixing the flange of the pouring element to the lid in a liquid-tight fashion. Sealing a section of a closure film on the pouring element so that the pouring opening of the pouring element still remains open. Connecting the lid to the container body in a liquid-tight fashion. Sterilizing an interior of the container. Filing the container with a product through the pouring opening. Closing the container by sealing the closure film onto the pouring element in such a fashion that the pouring opening of the pouring element is closed in a liquid-tight fashion and applying the cap to the pouring element.

5 Claims, 2 Drawing Sheets

U.S. PATENT DOCUMENTS

| | | | | | |
|---|---|---|---|---|---|
| 3,050,914 | A | * | 8/1962 | Morgan, Jr. | 53/426 |
| 3,943,682 | A | * | 3/1976 | Rausing | 53/415 |
| 3,973,719 | A | * | 8/1976 | Johnson et al. | 229/5.6 |
| 4,015,325 | A | * | 4/1977 | Theobald et al. | 29/451 |
| 4,131,211 | A | * | 12/1978 | Corbic | 215/2 |
| 4,155,439 | A | * | 5/1979 | Fletcher et al. | 198/339.1 |
| 4,318,703 | A | * | 3/1982 | Richards et al. | 493/149 |
| 4,754,890 | A | * | 7/1988 | Ullman et al. | 215/232 |
| 4,872,571 | A | | 10/1989 | Crecelius et al. | |
| 5,125,886 | A | * | 6/1992 | Dirksing | 493/87 |
| 5,135,462 | A | * | 8/1992 | Stahlecker et al. | 493/87 |
| 5,209,795 | A | | 5/1993 | DeRossa et al. | |
| 5,285,954 | A | * | 2/1994 | Goglio | 229/125.14 |
| 5,498,225 | A | * | 3/1996 | Nedstedt | 493/87 |
| 5,860,461 | A | | 1/1999 | Geiss | |
| 6,183,691 | B1 | * | 2/2001 | Swank et al. | 422/24 |

FOREIGN PATENT DOCUMENTS

| | | | |
|---|---|---|---|
| DE | 40 14 774 | A1 | 11/1991 |
| DE | 690 21 078 | T2 | 12/1995 |
| DE | 692 06 903 | T2 | 6/1996 |
| DE | 19615735 | | 10/1997 |
| EP | 0522 326 | | 1/1993 |
| WO | WO 91/00826 | | 1/1991 |

OTHER PUBLICATIONS

Decision to Grant issued by the European Patent Office dated Oct. 12, 2006.

* cited by examiner

METHOD FOR APPLYING A RESEALABLE POURING ELEMENT TO A CONTAINER AND CORRESPONDING CONTAINER

BACKGROUND OF THE INVENTION

Field of the Invention

The invention relates to a method for applying a reclosable pouring element comprising a pouring opening and a flange with a threaded ferrule and provided with a closure film and having a removable cap to a container having an opening and a container manufactured using such a method, comprising a sleeve-like body, a base and a lid, comprising the following steps: connecting the pouring element to a lid of the container having an opening by affixing the flange of the pouring element to the lid in a liquid-tight fashion, connecting the lid to the body in a liquid-tight fashion, connecting the base to the body, sterilising the interior of the container including the pouring opening, filling the container with a product through the pouring opening, closing the container by sealing the closure film onto the pouring element in such a fashion that the pouring opening of the pouring element is closed in a liquid-tight fashion, and applying the cap to the pouring element.

When 'container' is mentioned in the following, this should be understood as any container without restriction as to type, cross-section, shape or material. The same applies to the pouring elements to be used. The invention comprises all types of reclosable pouring elements, one-part or multipart, those with screw closures, snap closures or the like.

DETAILED DESCRIPTION OF THE INVENTION

DE 690 21 078 T2 describes a method for affixing a pouring spout having a flange to a cardboard container consisting of a cardboard/plastic composite material. The pouring spout having a sealing membrane (closure film) already affixed thereto and a pre-assembled screw-on cap, is inserted into a cut-out opening in the cardboard wall and is affixed there to the cardboard container by means of an ultrasound horn and anvil.

A similar prior art is disclosed in DE 692 06 903 T2. In the method described there the closure film is already sealed in a liquid-tight fashion on the pouring element before the pouring element is applied to the cardboard container.

A disadvantage with the afore-mentioned prior art is that the container must always have a pre-prepared opening to accommodate the pouring or emptying element and a further opening for filling. This results in a relatively high design expenditure for the application or filling machines and is also disadvantageous with regard to hygiene requirements since, as rapidly becomes apparent, the known containers can only be sterilised after the pouring or emptying element has been inserted and closed in a liquid-tight fashion.

A generic method for applying a reclosable pouring element to a container having an opening is already known from the registered documents of the German Utility Model G 90 05 581, wherein after joining the pouring element to the lid of the container in a liquid-tight fashion, the container is filled with a product through the pouring opening after which the container is closed by sealing a closure film onto the pouring element such that the pouring opening of the pouring element is closed in a liquid-tight fashion wherein the pouring element is finally closed by a cap. However, the packaging container manufactured by the known method cannot easily be used for the storage of foodstuffs. Rather, a considerable expenditure is required for this purpose since after filling the previously sterilised container, the supplied closure film must also be sterilised which involves considerable design work.

SUMMARY OF THE INVENTION

Thus, the object of the present invention is to develop and refine the method specified initially and described previously in detail for applying a pouring element to a container for drinks or another liquid product and a container manufactured according to the method such that the closure film to be applied can be reliably sterilised with little design expenditure.

In terms of method this object is solved by a method having the features specified in the preamble of claim 1 by sealing a section of the closure film on the pouring element before sterilisation such that the pouring opening of the pouring element still remains open until filling.

The invention has recognised that the sterilising process required in any case to sterilise the container interior can be used at the same time to sterilise the closure film to be sealed on after the filling process in the same working process without the quantity of sterilising medium needing to be increased. Whereas in the prior art, the area to be sterilised is always relatively large because of the feed tools located therein, in the method according to the invention this is restricted to a small region.

According to a further teaching of the invention, the section of the closure film is sealed laterally on the threaded ferrule so that the closure film stands upright and is reliably stabilised during the sterilising process.

A further preferred embodiment of the method according to the invention consists in the fact that the container having the pouring element affixed thereon and the closure film sealed onto the pouring element with the pouring opening of the pouring element open, is inserted at least with the lid of the container having the pouring element into a region delimited by side walls, which is used to supply a sterilising means in the direction of the container and encloses the circumference of the container in the area of the lid having the pouring element tightly or with little tolerance.

High security against any contamination of the product poured into the container or the product-guiding parts is especially achieved if according to a further advantageous embodiment of the method, the container at least with the lid having the pouring element remains in the delimited region during the filling of the container and the liquid-tight closure of the pouring opening by sealing the closure film on the pouring element.

The container according to the invention with a reclosable pouring element having a pouring opening and a flange and a removable cap, wherein the pouring element is constructed as a threaded ferrule and the cap is constructed as a screw-on cap, is distinguished by the fact that the pouring element has a thread-free region on its outer circumference for sealing a section (8) of the closure film.

A "separation" of the container into lid, sleeve-like body and base results in a simplified manufacture of the 'complicated' parts such as the joining of the lid to the pouring element. In this case, it is possible for the base to be joined in a liquid-tight fashion to the body before or, alternatively, after applying the lid.

The container manufactured by the method according to the invention can be used both for fresh and for aseptic products. In the case of aseptic products, the container and the parts which come in contact with the products poured therein can be sterilised before the filling process. However, it is also possible to sterilise the containers manufactured according to the invention after closure jointly with the product which has been poured in, for example, in an autoclave.

According to a further teaching of the invention, the pouring element to be applied comprises a pouring element with a cap constructed accordingly as a screw-on cap. In this case, the pouring element can preferably have a thread-free region on its outer circumference for sealing a section of the closure film. The area for sealing the section of the closure film is preferably constructed as a flattened area.

Further preferred and advantageous embodiments of the invention and especially of the container according to the invention are specified in the dependent claims.

The invention is explained in detail subsequently with reference to a schematic drawing showing merely one preferred embodiment. In the drawing:

DETAILED DESCRIPTION OF THE INVENTION

Figure 1:
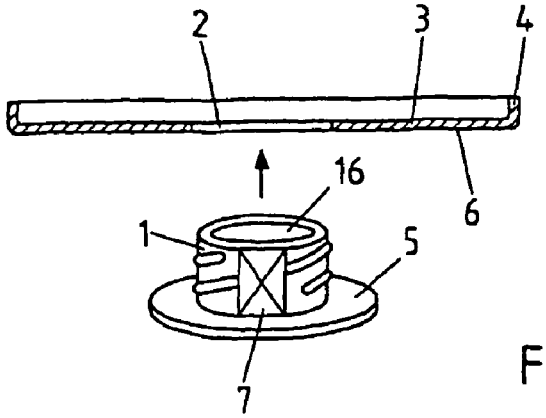
FIG. 1 shows a schematic side view of a lid of a container with an opening to accommodate a pouring element before its insertion.

As shown in FIG. 1, a pouring element 1 of a pouring element is inserted into an opening 2 of a container lid 3. The shape of the container lid 3 is matched to the cross-section of a container to be filled which is not shown and has an upwardly bent edge 4 for connection to this container. The pouring element 1 is integrally provided with a flange 5 which rests on the inner side 6 of the container lid 3 so that the pouring element 1 penetrates through the opening 2 in the container lid 3. The flange is then connected in a liquid-tight fashion to the container lid 3 by gluing or welding to form the unit shown in FIG. 2.

Figure 2:
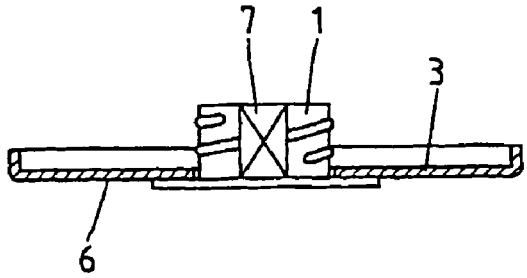
FIG. 2 shows the lid from FIG. 1 with the pouring element after its insertion.

It can be seen from FIGS. 1 and 2 that in the exemplary embodiment shown here and insofar preferred, the pouring element 1 has a thread-free region 7 on its outer circumference for sealing a section 8 of a closure film 9. The thread-free region 7 is preferably constructed as a flattened area, as can be seen from FIGS. 1 and 2. The closure film 9 is initially sealed only with its (in the diagram, lower) section 8 on the thread-free region 7 of the pouring element 1 and in a fashion such that the closure film 9 is aligned substantially perpendicular to the lid 3 or flange 5 of the pouring element 1 (see FIGS. 3 to 5).

Figure 3:
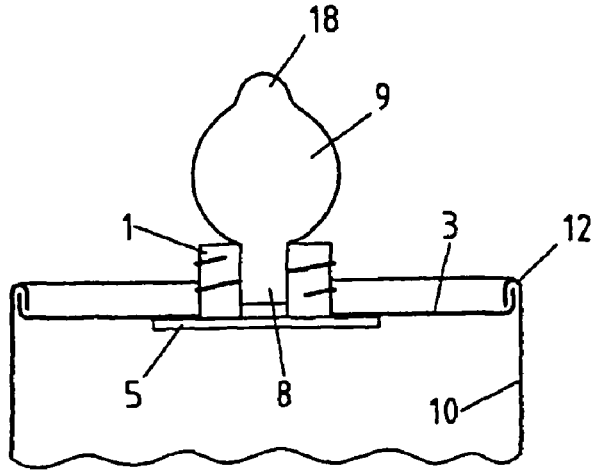
FIG. 3 shows the object from FIG. 2 with the closure film sealed thereon.

For a better representation the object from FIGS. 1 to 3 is shown rotated through 90° in FIGS. 4 to 7. The container can have an arbitrary cross-section and in the exemplary embodiment shown has substantially the shape of a can. It is accordingly constructed of the lid 3, a body 10 and a base 11 which preferably consist of a cardboard-based liquid-tight cardboard/plastic composite material. The base 11 like the lid 3 has a bent connecting edge 4 which engages in a flanged connecting edge 12 of the body 10 (see FIGS. 3 and 4).

The flange 5 of the pouring element 1 is preferably affixed to the lid 3 before this is connected to the body 10. However, it is also possible to affix the flange 5 of the pouring element 1 to the inner side 6 of the lid 3 after the latter has already been joined to the body 10 as long as the body 10 is not yet closed by the base 11 to be joined thereto.

The section 8 of the closure film 9 is sealed on the thread-free region 7 of the pouring element 1 either before joining the lid 3 and the body 10 or after these have been joined.

If the container is to be sterilised before filling, FIGS. 4 to 7 show a for example bounded region denoted by the reference number 13 which can be formed by side walls 14 or the like. The region 13 is used to guide a sterilising means, for example, hot steam in the direction of the container. As already mentioned, it is also possible to use the method according to the invention without any sterilisation of the container.

After the section 8 of the closure film 9 has been sealed on the thread-free region 7 of the pouring element 1 and the container has been formed by joining the lid 3, the body 10 and the base 11 to the bent connecting edges 4 or the flanged connecting edge 12 in a liquid-tight fashion, the container with the pouring element 1 affixed thereto and the closure film 9 sealed thereon and with the pouring opening 16 of the pouring element 1 open is inserted into the delimited region 13 so far that at least the closure film 9 projecting substantially perpendicular to the lid 3 or flange 5, the pouring element 1 and the upper part of the container with the lid 3 protrude into the region 13.

Figure 4:
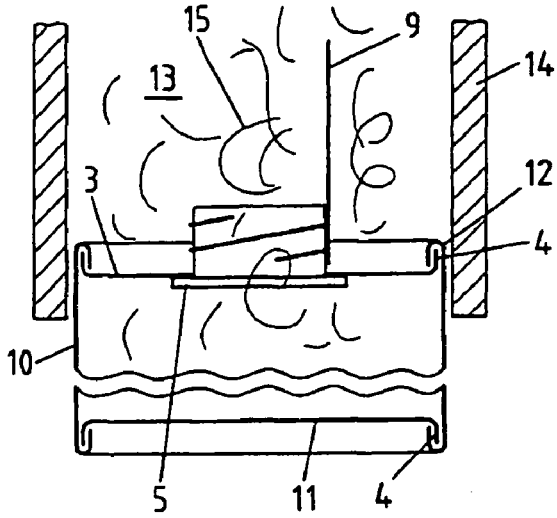
FIG. 4 shows a schematic cross-sectional view, rotated through 90°, of a container with the pouring element applied, during the sterilising phase.

As indicated schematically in FIG. 4, the interior of the container and the pouring element 1 including the closure film 9 are sterilised by means of hot steam or another sterilising means. The sterilising means is shown by wavy lines 15 in FIG. 4. The region 13 encloses the circumference of the container around the container lid 3.

Figure 5:
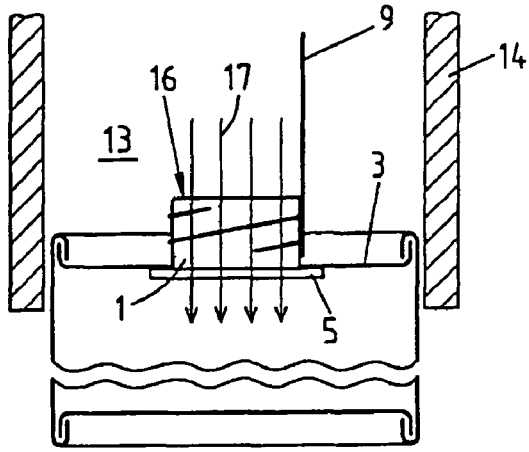
FIG. 5 shows the container from FIG. 4 during the filling phase.
Figure 6:
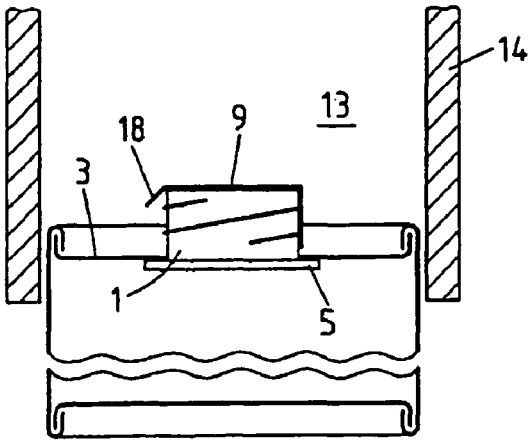
FIG. 6 shows the container from FIG. 4 with the pouring element closed.

After sterilising, the container is filled with the product to be filled via the pouring element 1, which is indicated by the downwardly directed arrows 17 in FIG. 5. Following the filling of the container, the closure film 9 is placed around and sealed on the upper edge of the pouring element 1 such that the pouring opening 16 of the pouring element 1 is closed in a liquid-tight fashion. A pull tab of the closure foil 9 not sealed onto the pouring element is denoted by 18 (see FIG. 6), and should be used for easier removal of the closure film 9 by the end user.

Figure 7:
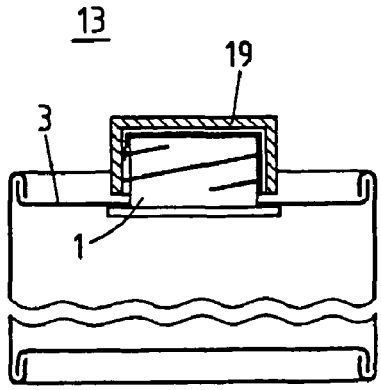
FIG. 7 shows the container from FIG. 4 with the pouring element closed and the cap placed thereon.

After the pouring opening 16 of the pouring element 1 has been closed by sealing the closure film 9, a cap, in the exemplary embodiment a screw-on cap 19, is finally applied to the pouring element 1, as shown in FIG. 7.

FIGS. 4 to 7 show that, in the exclusively shown case of sterile filling, the container with the lid 3 having the pouring element 1 remains inserted in the region 13 delimited by the side walls 14 during the filling of the container, the liquid-tight closure of the pouring opening 16 by sealing the closure film 9 on the pouring element 1 and the application of the screw-on cap 19 to the pouring element 1.

In the case shown, the container is only removed from the region 13 after applying the screw-on cap 19. The important elements of the container are thus arranged in a sterilised environment during the filling of the container and the closure of the pouring opening 16. However, it is also possible to remove the container from the region 13 after the liquid-tight closure of the pouring opening 16 by sealing the closure film 9 on the pouring element and to apply the screw-on cap 19 to the pouring element 1 outside the region 13.

If there is no need for sterile filling, the application of the closure film can preferably take place in a single-line fashion and the subsequent filling in a multi-line fashion. In this case it is clear that the single-line process must take place at a higher rate than the multi-line one.

The invention claimed is:

1. A method for applying a reclosable pouring element comprising a pouring opening, a flange with a threaded ferrule, a closure film and a removable cap to a container having an opening, wherein the container comprises a body, a base and a lid, comprising the steps of:

connecting the reclosable pouring element to the lid of the container having an opening by affixing the flange of the reclosable pouring element to the lid in a liquid-tight fashion;

connecting the lid to the body in a liquid-tight fashion;

connecting the base to the body;

sterilising an interior of the container including the pouring opening;

filling the container with a product through the pouring opening;

closing the container by sealing the closure film onto the reclosable pouring element allowing the pouring opening of the reclosable pouring element to be closed in a liquid-tight fashion; and applying the cap to the reclosable pouring element, wherein before sterilising, a section of the closure film is sealed to a thread free area of the threaded ferrule of the reclosable pouring element in such a way that the pouring opening of the reclosable pouring element remains open while sterilising and until filling.

2. The method according to claim 1, wherein the section of the closure film sealed prior to sterilising is sealed onto the reclosable pouring element after connecting the redo sable pouring element to the lid of the container.

3. The method according to claim 1, wherein the threaded ferrule includes an unthreaded region and the section of the closure film sealed prior to sterilising is sealed laterally on the unthreaded region of the threaded ferrule.

4. The method according to claim 1, wherein the container with the reclosable pouring element affixed thereto and the closure film sealed on the reclosable pouring element with the pouring opening still open, further wherein the container is inserted with at least the lid having the reclosable pouring element into a region delimited by side walls serving as a guide for a sterilising means in a direction of the container and encloses tightly or with a small tolerance a circumference of the container in a region of the lid having the reclosable pouring element.

5. The method according to claim 4, wherein the container with at least the lid having the reclosable pouring element remains in the delimited region during a filling of the container and a liquid-tight sealing of the pouring opening by sealing the closure film on the reclosable pouring element.

* * * * *

UNITED STATES PATENT AND TRADEMARK OFFICE

CERTIFICATE OF CORRECTION

PATENT NO. : 7,516,595 B2
APPLICATION NO. : 10/520673
DATED : April 14, 2009
INVENTOR(S) : Dammers et al.

It is certified that error appears in the above-identified patent and that said Letters Patent is hereby corrected as shown below:

Column 6, "redo sable" should read -- reclosable --

Signed and Sealed this

Eleventh Day of August, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,516,595 B2
APPLICATION NO. : 10/520673
DATED : April 14, 2009
INVENTOR(S) : Dammers et al.

It is certified that error appears in the above-identified patent and that said Letters Patent is hereby corrected as shown below:

Column 6, line 6, "redo sable" should read -- reclosable --

This certificate supersedes the Certificate of Correction issued August 11, 2009.

Signed and Sealed this

First Day of September, 2009

David J. Kappos

David J. Kappos
*Director of the United States Patent and Trademark Office*